United States Patent [19]

Bickford

[11] 3,966,203

[45] June 29, 1976

[54] RESISTANCE TYPE GOLF SWING PRACTICE AND EXERCISE DEVICE

[76] Inventor: Richard A. Bickford, No. 2 Pocahontas Drive, Dade City, Fla. 33525

[22] Filed: Mar. 10, 1975

[21] Appl. No.: 557,184

[52] U.S. Cl. ..... 272/118; 273/191 B

[51] Int. Cl.[2] ..... A63B 21/00

[58] Field of Search ..... 272/81, DIG. 4, 80, 272/82, 83 R, 67, 68; 273/193 R, 193 A, 194 R, 194 A, 200 R, 191 R, 191 B, 186 A, 186 B, 186 R; 184/15 R

[56] References Cited

UNITED STATES PATENTS

| | | | |
|---|---|---|---|
| 323,792 | 8/1885 | Coop et al. | 272/81 |
| 382,440 | 5/1888 | Sanchez | 272/81 |
| 2,455,707 | 12/1948 | Sheffer | 273/191 B |
| 2,846,705 | 8/1958 | Marz | 184/15 R X |
| 3,442,513 | 5/1969 | Fisher | 272/80 X |
| 3,462,156 | 8/1969 | Gentry | 273/186 A |
| 3,604,712 | 9/1971 | Prior | 273/186 R |
| 3,708,167 | 1/1973 | Potgieter | 272/80 X |

*Primary Examiner*—Richard C. Pinkham
*Assistant Examiner*—William R. Browne
*Attorney, Agent, or Firm*—Kemon, Palmer & Estabrook

[57] ABSTRACT

A golf swing practice and exercise device comprises a vertical guide member, e.g., an open-ended tube, a free-fall weight which moves vertically along the guide member, a cord attached at one end to the weight and at the other end to a sock to attach it to the head of a golf club, a fairlead at the top of the guide member and another fairlead located about head-high on the guide member. The cord passes through the fairleads and applies a "pull" on a golf clubhead equal to the weight which can be changed to vary the degree of exercise obtained in use of the device.

7 Claims, 6 Drawing Figures

RESISTANCE TYPE GOLF SWING PRACTICE AND EXERCISE DEVICE

BACKGROUND OF THE INVENTION

1. Field of the invention

This invention relates to a sporting device. More particularly it concerns a device for use by golfers to improve their golf swing and to exercise the muscles used in the golf swing.

2. Description of the Prior Art

Most golfers are aware of basic principles of a good golf swing to attain accuracy and distance, e.g., square to square, strong left side, low and slow backswing, deliberate downswing, inside-outside swing and steady head. Although they may know of these basic principles, many golfers are not able to consistently swing a golf club according to them and require practice in order to improve their golf swing ability. Moreover, many golfers because of business or family limitations on their time are no able to play a game of golf frequently enough to attain a consistently good swing or maintain the muscles of their body which are involved in executing a good golf swing with power in top condition.

Practice is, of course, essential to the attainment of a golf swing approaching the ideal. Obviously, practice time can be increased if this can be accomplished without restriction by adverse weather or need to travel substantial distances for its accomplishment.

Many forms of devices for practicing golf swing and exercising muscles involved in swinging a golf club are known. Most of these utilize some form of restraining means which will control the movement of the golf club head during use of the device by the golfer. One general form of such devices uses circular tracks to guide the club while the golfer stands inside the circular track. Such equipment is generally complicated in construction, inconvenient to use because of size and of doubtful utility in actually helping the golfer to attain a proper golf swing because of restricting the club head movement into a single arc. Actually, a proper golf swing involves a more complex movement then simply passage through a single fixed arc.

Another type of golf swing practice device applies restraining force to the practicer's arm movements by means of flexible lines or cords which move from some control point positioned away from but in the vicinity of the practicing golfer, e.g., see U.S. Pat. No. 2,455,707; 2,655,378 and 3,462,156.

A number of devices for use by a golfer have also been suggested which have as a principle purpose the development of muscles used in performing a golf swing rather than concentrating on developing the form of the club swing performed by the golfer, e.g., see U.S. Pat. No. 2,848,234.

Notwithstanding the substantial number of prior known devices for use in improving golf swing form and/or muscle strength and tone, there is a need for a device which can provide both swing and muscle improvement without requiring the purchase of expensive equipment or need to provide permanent and large space for its use.

OBJECTS

A principle object of this invention is the provision of a new form of device for golf swing practice and exercise.

Another object is the provision of such a device which will improve the accuracy and distance with which a golfer may hit a golf ball which need not be permanently assembled and which need not be used out of doors, i.e., can be used in the comfort and convenience of the golfer's own home.

A still further object is the provision of such a device which will help the golfer to build those muscles which are involved in a perfect golf swing to improve the golf swing as to power as well as form.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of a golf swing practice and exercise device which comprises a free-fall weight member, a longitudinally elongated guide member, preferably a hollow tube, adapted to maintain said weight member during movement thereof in a straight path, mounting means to hold said guide member in a substantially vertical position, a cord fixed at its proximal end to means for attaching it to the head of a golf club, means on said weight member by which the distal end of said cord is fastened thereto, a first fairlead for said cord fixed to the top of said guide member, and a second fairlead for said cord carried by said guide member between the ends thereof.

Advantageously, the guide member is an open ended tube formed of plastic material with a glossy inside surface and the mounting means therefor is a pair of spaced apart lugs fixed to the tube with each lug having a pair of holes therein through which screws may be passed to fasten the tube to a wall or some other upright support.

Pulleys or guide eyes may be used as the fairleads to control the path of the cord. The cord itself may be of any suitable construction, but is preferably impregnated or coated with a lubricant to assist it in passing through the fairleads.

A further feature of the new device is the provision of a plurality of interchangeable weight members of different weight enabling the user of the device to obtain different degrees of isometric exercise through use of the device.

DESCRIPTION OF PREFERRED EMBODIMENTS

Figure 1:
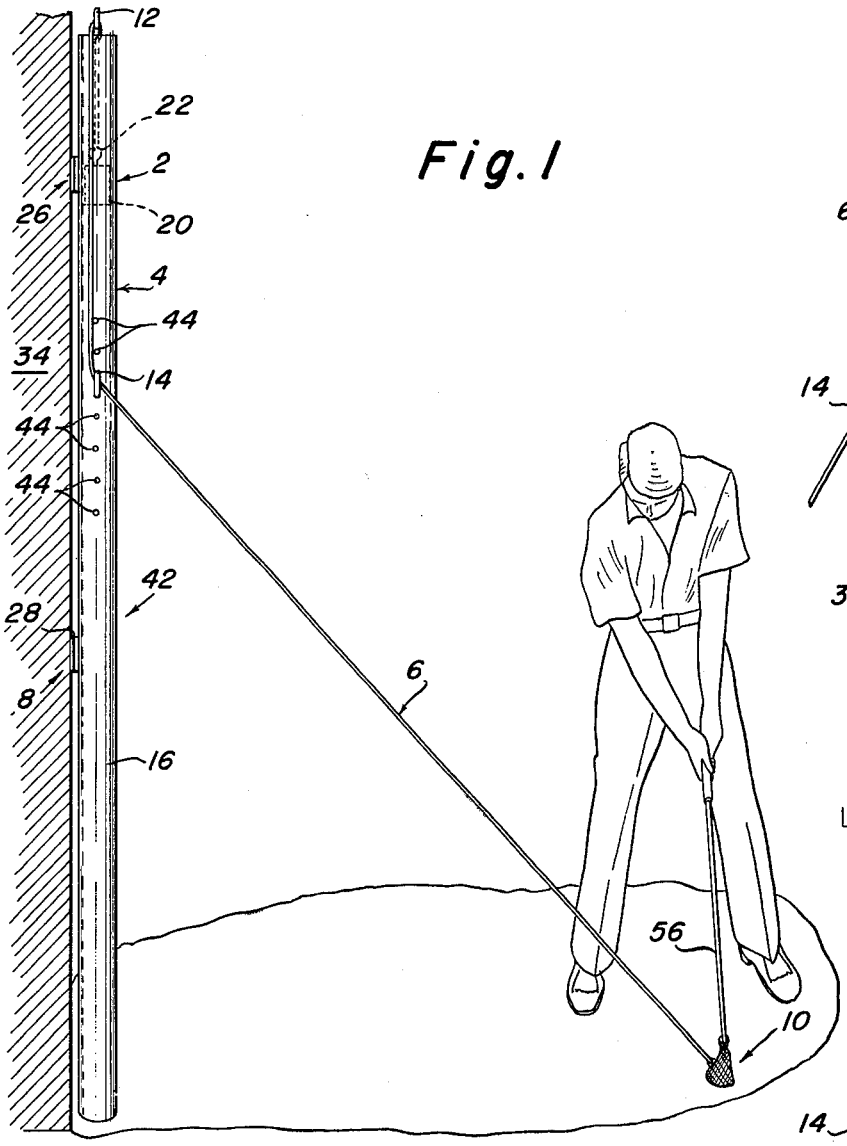
FIG. 1 is an elevational view of one embodiment of a golf swing practice and exercise device of the invention shown being used by a golfer.
Figure 2:
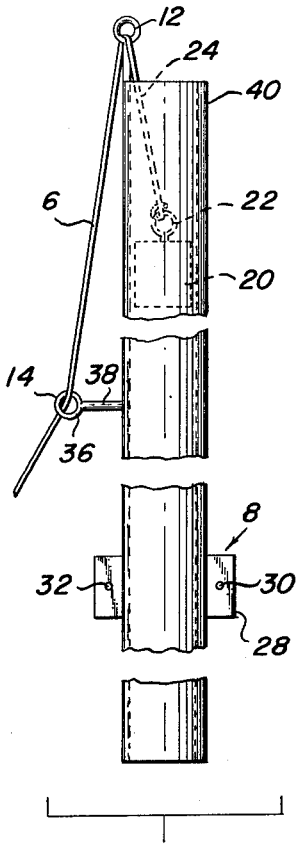
FIG. 2 is a fragmentary elevational view primarily of the guide member portion of the new device.
Figure 4:
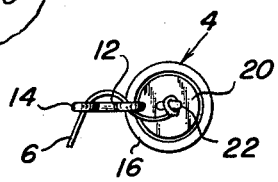
FIG. 4 is a plan view of the device of FIG. 1.

With more detailed reference to the drawing, the new golf swing practice and exercise device comprises a free-fall weight member 2, a longitudinally elongated guide member 4, a cord 6, guide member mounting means 8, cord attaching means 10, a first fairlead 12 and a second fairlead 14.

The guide member 4 can be any longitudinally elongated member adapted to maintain the weight member 2 during its movement in a straight path such as a channel member, a grooved member in which a tongue formed on the weight member may slide, but preferably the member 4 is a tube 16 of circular cross-section, although it may have any other suitable cross-section, e.g., square, rectangle, hexagon or the like. The tube may be formed of any material such as metal, wood, cardboard but advantageously it is formed of plastic material preferably with a smooth or glossy inside surface. Polyethylene, polypropylene, polystyrene, vinyl chloride polymer and the like are examples of plastics from which the tube may be molded or extruded. A length of eight feet is suitable for the guide member. If this sould be too long for the user to mount indoors, such as a bedroom or den, a sufficient length can be cut from the lower end 18 of the guide member 4 in order to accommodate the device to the ceiling height limitations.

The weight member 2 may be formed of a variety of shapes and form any suitable material. Where the guide member 4 is a tube 16 of circular cross-section, a cylindrical weight 20 having a diameter which permits the weight to slide easily within the tube can be used. If the guide member is a tube of other cross-sectional shape, the weight member would advantageously have a similar configuration of slightly smaller cross-section although a totally unrelated shape could be used such as a teardrop, ball or the like. Preferably, the weight is formed of lead, but brass, steel, plastic coated iron, ceramic or the like can be used. An eye 22 or equivalent fastening means is provided on the weight 20 so that the distal end 24 of the cord 6 may be fastened to the weight. By way of example, the weight 20 can be about one to two pounds. However, the device is preferably supplied with a plurality of interchangeable weight members of differing weight which may be used individually or in combination so that force applied to the cord in practice and exercise can be varied, e.g., one each of ¼, ½ and 1 pound weights and two ⅛ pound weights. As a modification, the weight member 2 may comprise a basket or container into which complimentary sized weights can be inserted.

The mounting means 8 to hold the guide member 4 in a substantially vertical position can take a variety of forms, e.g., pipe straps, staples or the like may be used. Preferably, however, the mounting means will be a pair of lugs 26 and 28 which are cemented or welded to the tube 16, each lug having a pair of holes 30 and 32 therein through which screws (not shown) may be passed to hold the guide member 4 against a wall 34 or equivalent support member.

The fairleads 12 and 14 as illustrated are eye-guides formed of a ring 36 and a shank 38. Any other suitable form of fairlead may be used including pulleys, eye-strap, etc.. The top fairlead 12 may be fixed, e.g., by cement or weldment, to the top 40 of the guide member 4, or it may be releasable held there, e.g., by a strap encircling the tube 16, by having its shank threaded into the tube end, etc..

The fairlead 14 may be fixed in position upon the guide member 4 at a height that would be about 6 feet above the lower end 18 of the guide member, i.e., about shoulder-height or slightly higher for the average golfer. However, the device preferably includes means 42 to permit the height of the fairlead 14 to be adjusted. In FIG. 1 such means comprises a series of holes 44 in the tube 16 threaded to receive the threaded end of the shank 38. Alternatively, the means 42 (see FIG. 5) may comprise a channel member 36 in which a base plate 48 to which the fairlead 14 is fixed may be moved. Also, the means 42 (see FIG. 6) may comprise a pipe-strap 50 which encircles the tube 16 and holds the fairlead 14 in position by passing through the base ring 52. The position changing means 42 permits the new device to adjust to different sized users. It also facilitates use of the device in practice of the putting stroke.

Figure 3:
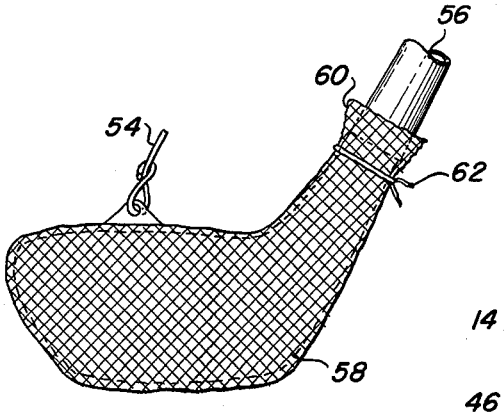
FIG. 3 is a fragmentary elevational view illustrating a preferred means for attaching the head of a golf club to the control cord of the new device.
Figure 5:
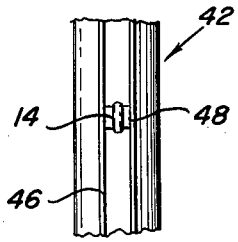
FIG. 5 is a fragmentary elevational view showing a means for holding the lower cord fairlead at a different position.
Figure 6:
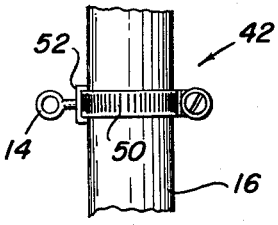
FIG. 6 is a fragmentary elevational view showing another fairlead position adjustment means.

The means 10 for attaching the cord 6 at its proximal end 54 to the head of a golf club 56 as shown in FIG. 3 comprises a fabric sock 58 which may be gathered at the end 60 and closed around the golf club shaft by a tie 62. However, the means 10 may take other forms such as a club head boot or club shaft jacket as shown in FIGS. 3 and 5 respectively of U.S. Pat. No. 2,455,707, the disclosure of which is incorporated herein by reference.

The cord 6 may be of any suitable construction, e.g., braided or plyed, and size, e.g., 1/16–¼ inch diameter. Advantageously, the cord is coated or impregnated with lubricant, e.g., zinc stearate graphite, $MoS_2$, oil, etc., to reduce friction in passing through the fairleads.

In use, the practicing golfer 64 will take the proper stance near the device so that upon backswing the club 56 will clear the member 4 and fairlead 14. As the golfer moves from the address position into the backswing, if it is done too rapidly (an undesirable trait) this will cause the tether cord 6 momentarily to go slack resulting in prompt jerking of the cord by the falling weight to train the golfer to follow a low, slow backswing. In the backswing and subsequent downswing, the action of the weight and cord will assist the golfer to maintain a straight-arm condition for the leading arm and require a deliberate downswing. Operating on the isometric exercise principle (resistance to line of direction), the device will build the golfer's muscle-tone in the precise muscles required while helping to perfect an ideal golf swing form. The device, furthermore, permits this to be accomplished with relatively simple and inexpensive equipment usable in limited space such as den, office, garage or the like under adverse weather conditions or out-of-doors when the weather is conducive.

I claim:

1. A golf swing practice and exercise device for use in training and building the muscles of the body employed in swinging of a golf club which comprises:

a free-fall weight member, a tube adapted to receive said weight member and to maintain it during movement thereof in a straight path, mounting means to hold said tube in a substantially vertical position, a golf club, a cord fixed at its proximal end to means attaching it to the head of said golf club, means on said weight member by which the distal end of said cord is fastened thereto, a first fairlead for said cord fixed to said guide member adjacent the top thereof, a second fairlead for said cord and, means to hold said second fairlead at different positions between the ends of said tube during a practice swing of the golf club by a user to cause raising and lowering of said weight member.

2. The device of claim 1 wherein said fairleads are pulleys.

3. The device of claim 1 wherein said fairleads are guide eyes.

4. The device of claim 1 having a plurality of interchangeable weight members of differing weight.

5. The device of claim 1 wherein said tube is formed of plastic material with a glossy inside surface.

6. The device of claim 5 wherein said mounting means are a pair of spaced apart lugs fixed to the tube, each lug having a pair of holes therein through which screws may be passed.

7. A golf swing practice and exercise device for use in training and building the muscles of the body employed in swinging of a golf club which comprises:

a free-fall weight member, a tube adapted to receive said weight member and to maintain it during movement thereof in a straight path, mounting means to hold said tube in a substantially vertical position, a cord fixed at its proximal end to a sock by which to attach it to the head of a golf club, means on said weight member by which the distal end of said cord is fastened thereto, a first fairlead for said cord fixed to said guide member adjacent the top thereof, a second fairlead for said cord and, means to hold said second fairlead at different positions between the ends of said tube.

* * * * *